United States Patent [19]

Matlock

[11] 4,384,515

[45] May 24, 1983

[54] APPARATUS FOR POSITIONING AND HOLDING TRUSS MEMBERS

[75] Inventor: Gordon E. Matlock, Sullivan, Mo.

[73] Assignee: Moehlenpah Industries, Inc., St. Louis, Mo.

[21] Appl. No.: 202,866

[22] Filed: Oct. 31, 1980

[51] Int. Cl.[3] ..... B30B 9/00

[52] U.S. Cl. ..... 100/100; 100/295; 100/913; 269/910

[58] Field of Search ..... 100/913, 100, 295; 227/152; 269/910; 29/798

[56] References Cited

U.S. PATENT DOCUMENTS

| | | | |
|---|---|---|---|
| 3,868,898 | 3/1975 | Sanford | 100/913 X |
| 4,002,116 | 1/1977 | Knowles | 100/100 |
| 4,024,809 | 5/1977 | Moehlenpah | 100/100 |
| 4,044,093 | 8/1977 | Jureit | 269/910 X |
| 4,104,962 | 8/1978 | Castillo | 100/913 X |

*Primary Examiner*—Billy J. Wilhite

*Attorney, Agent, or Firm*—Senniger, Powers, Leavitt and Roedel

[57] ABSTRACT

Apparatus for positioning and holding on an elongate bed pieces of a floor truss of the type comprising a pair of generally parallel spaced-apart wood chord members and a series of relatively flat metal web members having connector portions with teeth struck therefrom to be pressed into the wood chord members for rigidly interconnecting them. The apparatus comprises an abutment having a first vertical clamping surface extending longitudinally with respect to the bed for engagement by one chord member, and a clamping mechanism for moving the web and chord members relative to one another from an initial unassembled position in which the web members are generally horizontal with the teeth facing upwardly and in which the wood chord members overlie the web members, to a final position in which the one chord member abuts the aforesaid clamping surface of the abutment and the connector portions of the web members are substantially centered on the lower faces of the chord members transversely with respect to the faces. The clamping mechanism also clamps the web and chord members in their final position.

38 Claims, 13 Drawing Figures

APPARATUS FOR POSITIONING AND HOLDING TRUSS MEMBERS

BACKGROUND OF THE INVENTION

This invention relates generally to apparatus useful in the fabrication of building trusses, particularly combination wood-metal floor trusses of the type comprising a pair of spaced-apart wood chord members (e.g., 2×4's) interconnected by a series of V-shaped metal web members, such as those shown and described in coassigned pending U.S. patent application Ser. No. 63,791.

The substitution of wood-metal floor trusses for solid lumber floor and ceiling joists has become widespread for several reasons, one being the relatively high cost of wood joists. Moreover, a combination wood-metal truss is lighter, stronger and enables duct work, piping and wiring to be routed through the truss in the open spaces between the chord members. However, several problems have arisen in the fabrication of wood-metal trusses. One problem involves the centering of the teeth struck from the V-shaped metal webs on the faces of the wood chord members so as to ensure that when the web and chord members are pressed together the maximum number of teeth are embedded in the chord members for maximum truss strength. In this regard, 2×4's are typically used as the wood chord members, with the teeth of the web members being pressed into the narrow faces of the 2×4's. However, centering the teeth on these relatively narrow faces is especially difficult to accomplish for at least two reasons. First, the thickness of the wood members may vary from member to member. For example, the thickness of one piece of timber may be 1-7/16 in. while another may be 1½ in. or 1-9/16 in. thick (the thickness of a standard 2×4 is 1½ in.). Moreover, despite the differences in thickness of the wood chord members, the outside dimension (i.e., depth) of the truss must be held within a relatively close tolerance (e.g., 1/16 in.) which is generally less than the cumulative tolerances of the wood chord members.

Another problem presented by prior apparatus for fabricating metal-wood trusses has been the relative difficulty of changing over from the fabrication of trusses of one size to the fabrication of trusses of a different size. This change-over has heretofore required substantial amounts of time and labor with consequent economic losses to the owner. Loading wood chord members into prior fabricating apparatus has also presented a problem, as has the removal of the finished truss from the apparatus.

SUMMARY OF THE INVENTION

Among the several objects of this invention may be noted the provision of improved apparatus for use in the fabrication of combination metal-wood flat floor trusses and the like; the provision of such apparatus which automatically centers the tooth portions of the metal web members on the faces of the wood chord members despite variations, within specified limits, in the thickness of the chord members, while also maintaining the outside dimension (i.e., depth) of the trusses within relatively close tolerances; the provision of such apparatus which is readily adjustable to fabricate trusses of various depths, lengths and configurations; the provision of such apparatus which is adapted for quick and easy loading of the wood chord members into the apparatus and for removal of the finished truss therefrom; the provision of such apparatus which securely holds the chord and web members in proper position relative to one another prior to and during the pressing operation; and the provision of such apparatus which is rugged in construction for increased durability, and which is reliable in operation.

Generally, apparatus of the present invention is used for positioning and holding on an elongate bed pieces of a structure to be fabricated, such as the pieces of a floor truss of the type comprising a pair of generally parallel spaced-apart wood chord members and a series of relatively flat metal web members having connector portions with teeth struck therefrom adapted to be pressed into the wood chord members for rigidly interconnecting them. The apparatus comprises abutment means having a first generally vertical clamping surface adapted to extend longitudinally with respect to the bed for engagement by one face constituting the outer face of one of the chord members, and clamping means adapted to be mounted on the bed for moving the metal web members and chord members relative to one another from an initial unassembled position in which the web members are generally horizontal with their teeth facing upwardly and in which the wood chord members overlie the web members, to a final position in which said one chord member abuts the aforesaid first clamping surface of the abutment means and the connector portions of the web members are substantially centered on the lower faces of the chord members transversely with respect to the faces. The clamping means also clamps the web and chord members in their final position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1A:
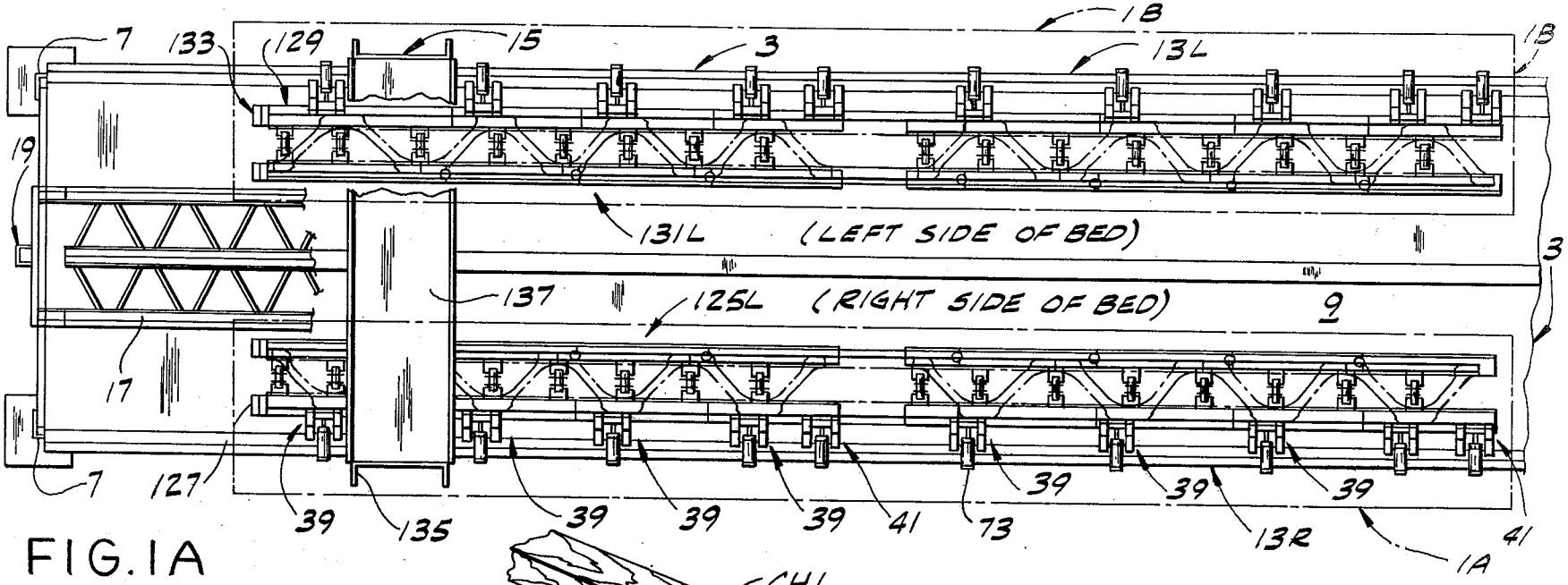
FIGS. 1A and 1B are plan views of a truss-fabricating machine comprising an elongate bed and apparatus for positioning and holding on the bed pieces of a floor truss.
Figure 3:
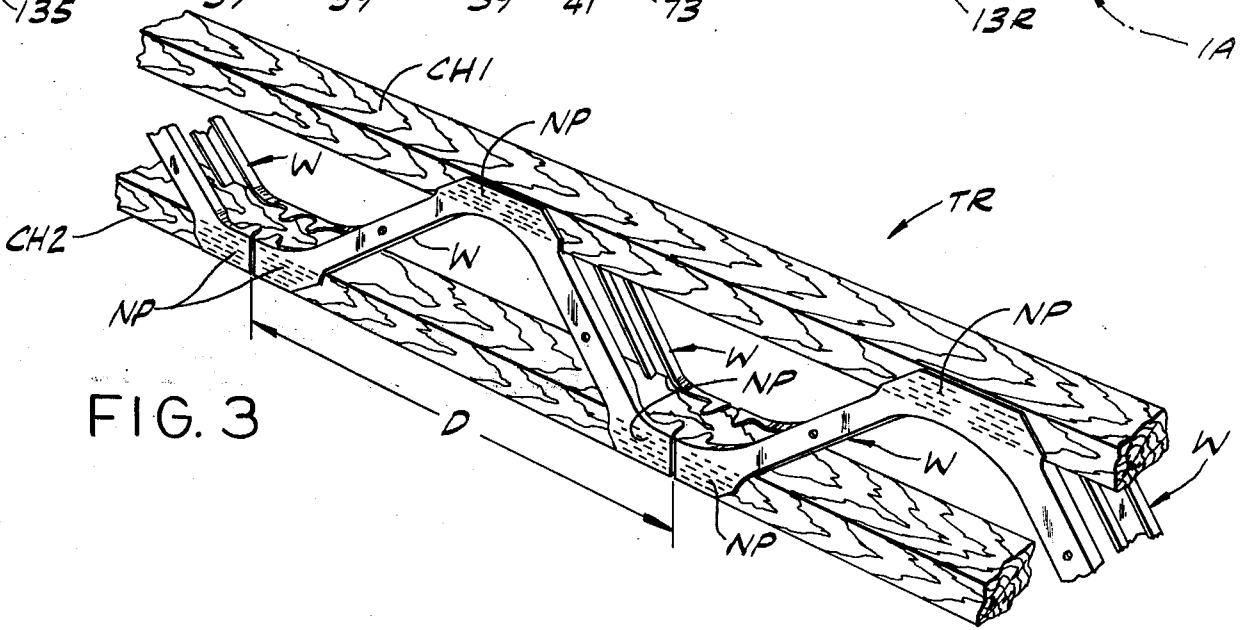
FIG. 3 is a perspective of part of a finished truss made by the machine.
Figure 1B:
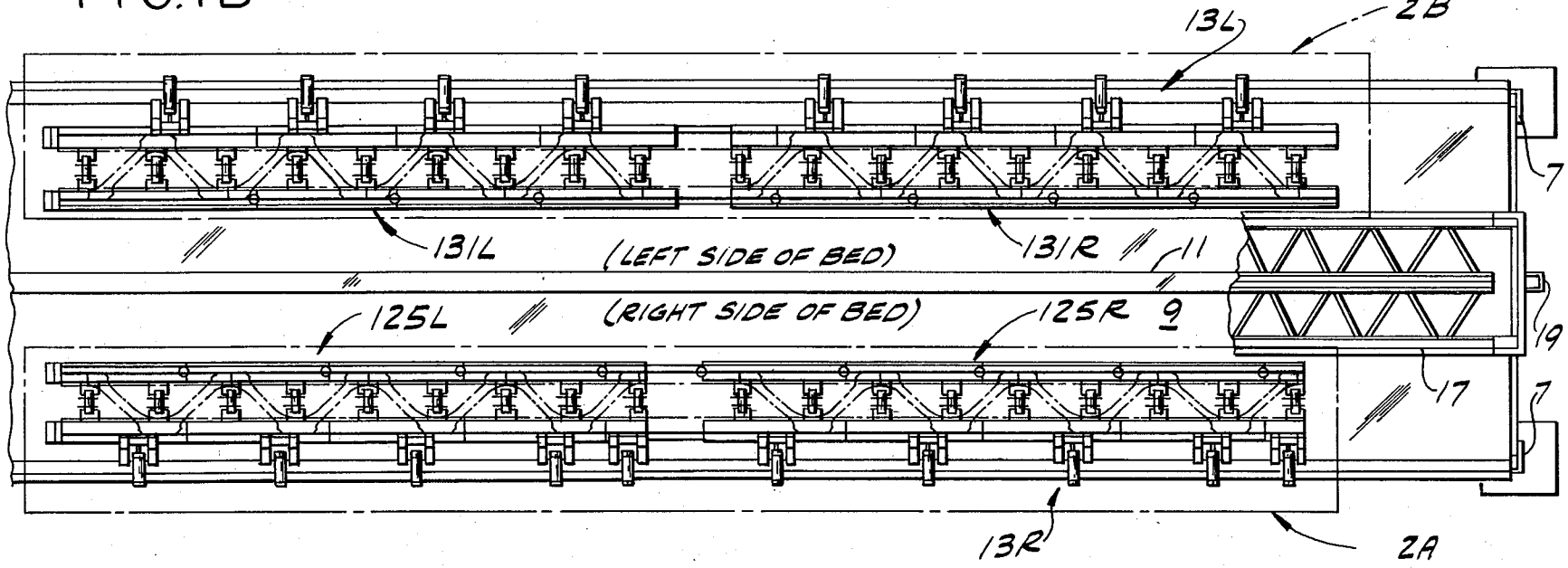
Figure 2:
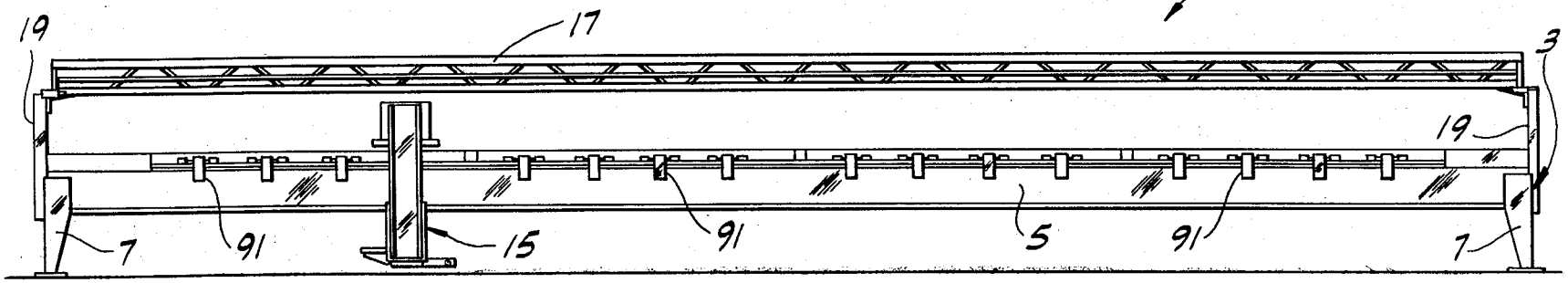
FIG. 2 is a side elevation of the machine.

Referring now to the drawings, particularly to FIGS. 1 and 2, a machine for fabricating flat trusses is designated in its entirety by the reference numeral 1. This machine is especially adapted for fabricating combination wood-metal floor trusses TR of the type shown in FIG. 3 as comprising a pair of generally parallel spaced-apart wood chord members CH1, CH2 (e.g., 2×4's) and a series of relatively flat V-shaped metal web members W spaced at intervals along the chord members on both sides thereof. These web members, which are described in detail in co-assigned pending U.S. patent application Ser. No. 63,791, have connector or nailing plate portions NP with teeth T struck therefrom which are pressed into the narrow (1½ in.) faces of the chord members to interconnect them to form truss TR.

The machine 1 comprises a relatively long table, generally indicated at 3, formed by a pair of parallel I-beams 5 (only one shown in FIG. 2) extending longitudinally of the table at opposite sides thereof, legs 7 at opposite ends of the beams at the four corners of the table, and a plurality of flat steel plates spanning the I-beams to form an elongate generally horizontal bed 9. A rectangular-section box beam 11 extends the length of the bed and divides it into right and left sides (as viewed from the left end of the table). The table is preferably of sufficient length to form one long (e.g., 36 ft.) truss on each side of the table or, alternatively, two shorter trusses (e.g., 18 ft.) on each side.

In accordance with this invention, machine 1 also includes apparatus or fixturing on each side of the bed for positioning and holding the web and chord members required to form a truss (or trusses), the apparatus on the left side of the bed being designated generally 13L and the apparatus on the right side 13R. As will appear, this apparatus is operable for moving the web and chord members relative to one another from an initial unassembled position (see FIG. 5) in which the metal web members W are spaced at intervals along the bed in generally horizontal position with teeth T facing upwardly, and in which the wood chord members overlie the web members with their lower narrow (e.g., 1½ in.) faces in contact with teeth T, to a final position (FIG. 6) in which the nailing plate portions NP are substantially centered transversely with respect to the lower faces of the chord members. The apparatus 13R, 13L is also operable to clamp the web and chord members in this final position. A second series of metal web members W is then manually placed atop the wood chord members generally opposite the lower series of web members, with the teeth of the upper web members facing downwardly and with the nailing plate portions NP substantially centered transversely with respect to the upper (e.g., 1½ in.) faces of the chord members.

A press, generally indicated at 15, is movable longitudinally with respect to the table for driving the teeth of the metal web members W into the upper and lower faces of the chord members CH1, CH2 when the web and chord members are clamped in their final position to form a completed truss TR. A triangular overhead framework 17 supported by vertical posts 19 at opposite ends of the table extends the length of the table over the press for holding cartons of metal web members W. The cartons may be placed at convenient locations where the metal webs are readily accessible by workmen.

Apparatus 13R on the right side of the bed comprises a camber rail 21R rigidly affixed to the bed and extending longitudinally with respect thereto from one end of the table to the other. As mounted on the bed, the camber rail is slightly curved over its length to impart a predetermined camber or arch to a finished truss, which is important for structural reasons. The rail 21R is generally L-shaped in section, having vertical and horizontal legs designated 23 and 25, respectively, the vertical leg being engageable with the outer (left as viewed in FIG. 7) vertical face of chord member CH1. The camber rail is rigidly secured (e.g., welded) with its horizontal leg spaced above the bed 9 to an angle bar 27 extending the length of the table. This bar 27 is secured in position on the table by means of a plurality of threaded rod assemblies 29 spaced at intervals longitudinally of the table. Each assembly comprises a rod 31 extending horizontally through the angle bar 27 and the box beam 11 at the center of the table, a nut 33 threaded on the rod, and a tubular spacer 35 disposed around the rod between the angle bar and the box beam for limiting the extent to which the nut may be threaded on the rod. This ensures that the proper camber in rail 21R is maintained.

Apparatus 13R further comprises clamping means constituted by a plurality of interconnected clamping sections extending longitudinally with respect to the table generally parallel to the camber rail 21R on the right side of the bed. The clamping sections are of two different types, namely, standard clamping sections, generally designated 39, and short clamping sections, generally designated 41. These sections are assembled and positioned on the bed according to the length and number of trusses to be fabricated, as more fully explained hereinafter.

Figure 5:
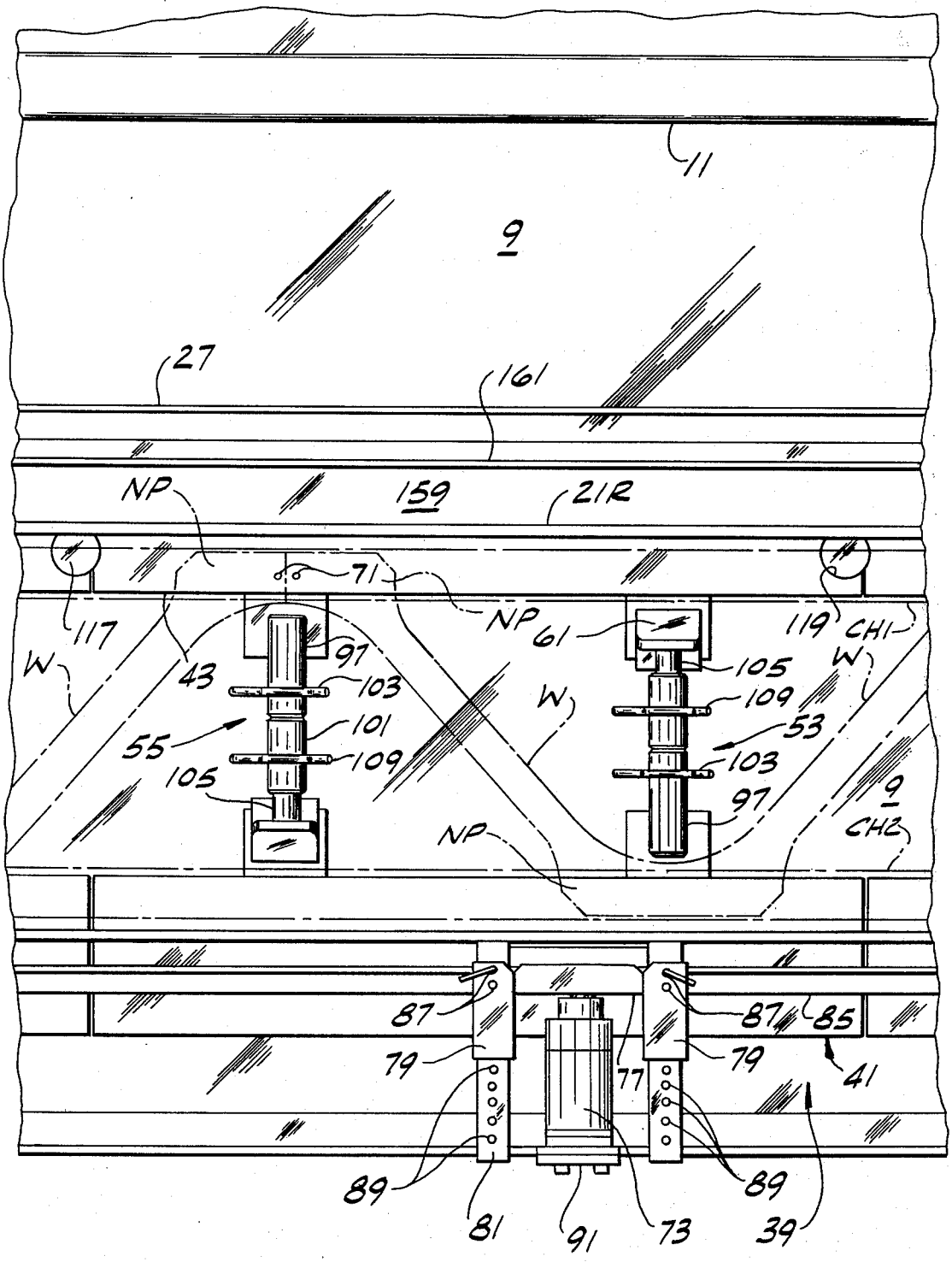
FIG. 5 is an enlarged plan of a portion of FIG. 4 showing a clamping section in open position.
Figure 8:
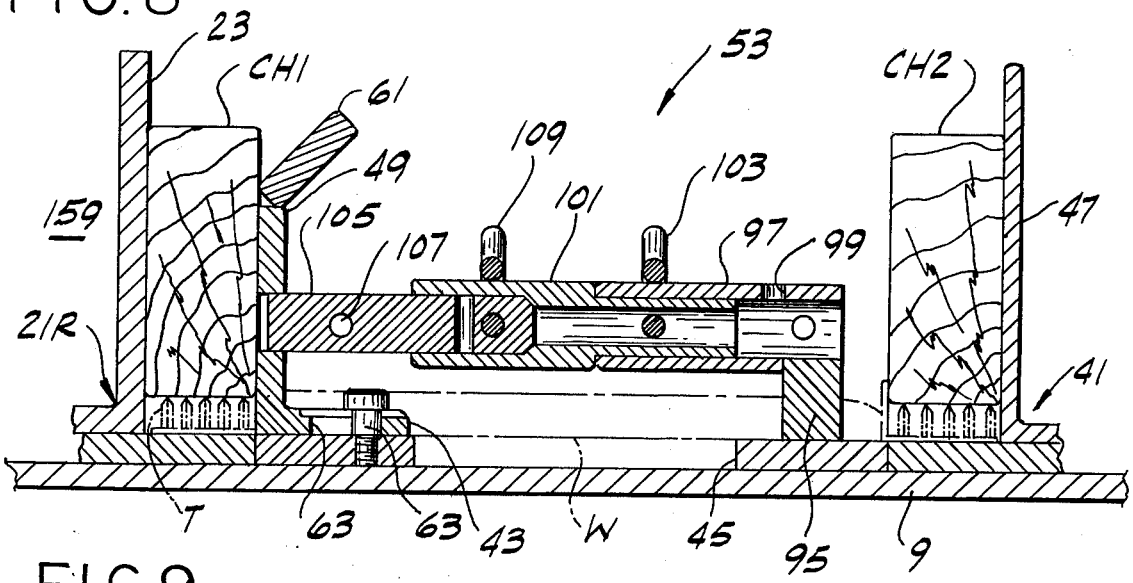
FIG. 8 is an enlarged vertical section on line 8—8 of FIG. 6.
Figure 9:
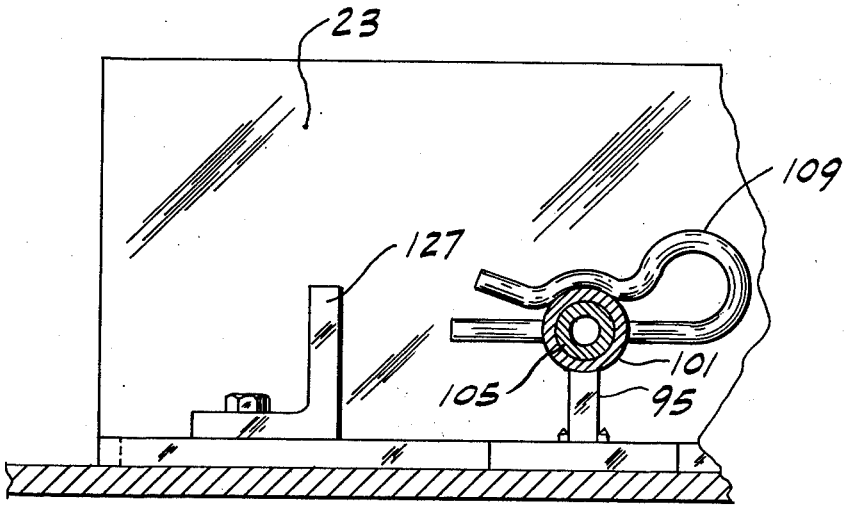
FIG. 9 is an enlarged vertical section on line 9—9 of FIG. 4.

As best illustrated in FIG. 5, each standard clamping section 41 comprises an outer clamping member 41 extending longitudinally with respect to the bed generally parallel to the camber rail 21R and an intermediate clamping member in the form of an elongate flat support plate 43 between and generally parallel to the camber rail and outer clamping member. As will appear, the clamping members 41, 43 are interconnected and slidable transversely with respect to the bed 9 toward and away from the camber rail (which constitutes abutment means), the left (as viewed in FIG. 8) longitudinal edge of the intermediate clamping member or support plate 43 being slidable beneath the chamber rail 21R. The outer clamping member 41 is of two-piece construction, comprising an elongate base plate 45 resting on the bed and a clamping bar 47 which is generally L-shaped in section, having a horizontal leg secured to the upper surface of the base plate adjacent the outer (right) longitudinal edge thereof, and a vertical leg engageable with the outer (right) vertical face of chord member CH2. The upwardly facing surfaces of the support and base plates 43, 45 are generally coplanar for supporting a metal web member W thereon in a generally horizontal position.

Figure 10:
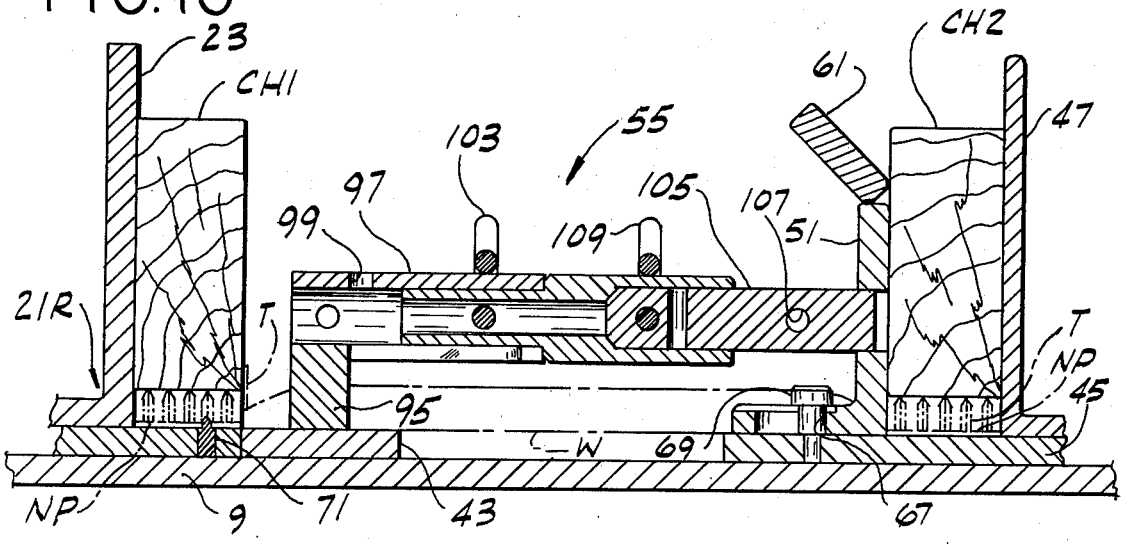
FIG. 10 is an enlarged vertical section on line 10—10 of FIG. 6.

The outer and intermediate clamping members 41, 43 carry a pair of jaws, designated 49 and 51, respectively. The first jaw 49 is mounted adjacent one end of clamping section 39 at the outer end of a jaw support means 53 (see FIG. 8) which extends from the base plate 45 of the outer clamping member toward the camber rail 21R, the jaw being positioned generally adjacent the latter for engagement with the inner (right) vertical face of chord member CH1. The second jaw 51 is mounted at the opposite end of clamping section 39 at the outer end of a jaw support means 55 which extends from the intermediate clamping member or support plate 43 toward the outer clamping member 41 (see FIG. 10), the arrangement being such that the jaw 51 is disposed generally adjacent the clamping bar 47 for engagement with the inner (left) vertical face of chord member CH2. Each jaw 49, 51 is generally L-shaped as viewed from the side, having horizontal and vertical legs. The vertical leg of jaw 49 is disposed in face-to-face relation and generally adjacent to the vertical leg 23 of camber rail 21R for receiving one chord member CH1 therebetween, and the vertical leg of jaw 51 is similarly disposed opposite the vertical leg of clamping bar 47 for placement therebetween of the other chord member CH2 of a truss to be fabricated. To facilitate placement of the chord members CH1, CH2 between the jaws and their respective opposing clamping surfaces, each jaw has an inclined guide piece 61 at its upper end which serves as a ramp to direct the chord members into position.

The outer and intermediate clamping members are interconnected by means of a pin-and-slot connection between jaw 49 and support plate 43 (the slot 63 being in the horizontal leg of the jaw and the pin 65 on the support plate) and a pin-and-slot connection between jaw 51 and the base plate 45 of the outer clamping member (the slot 67 being in the jaw and the pin 69 in the base plate). These connections permit lost-motion movement between the clamping members 41, 43 in the transverse direction with respect to the bed. While the connections maintain the clamping members 41, 43 substantially parallel, they are sufficiently loose to enable the sections to become slightly skewed (out of parallel) with respect to one another.

Pin 69 and slot 67 are so dimensioned and disposed that when the pin is at the extreme right end (FIG. 10) of the slot the spacing between jaw 51 and the vertical leg of clamping bar 47 is equal to the minimum acceptable thickness (e.g., 1⅜ in.) of chord member CH2, and when the pin is at the extreme left end of the slot the spacing is considerably greater than the maximum acceptable thickness (e.g., 1⅝ in.) of chord member CH2. The dimensions of pin 65 and slot 63 are substantially identical to those of pin 69 and slot 67.

A pair of locater pins 71 on the support plate 43 adjacent jaw support means 55 extend up through openings in a nailing plate portion NP of a metal web member W resting with teeth T facing upwardly in horizontal position atop support plate 43 and base plate 45 between camber rail 21R and clamping bar 47. These pins 71 constitute means for properly positioning the web member in the clamping section, that is, with the apex nailing plate portion NP of the web member generally adjacent the clamping bar and the two outer plate portions NP generally adjacent the camber rail. Other means for properly locating the metal web with respect to the clamping members may also be suitable.

Each standard clamping section 39 also includes a double-acting pneumatic cylinder unit 73 connected in conventional manner to a suitable source of pressurized air (e.g., 100 psi air). When actuated, the unit is operable for moving the outer clamping member 41 (and the intermediate clamping member or support plate 43) transversely with respect to the bed 9 toward and away from the camber rail 21R between an open position (FIG. 5) in which jaw 49 carried by the outer clamping member is spaced a sufficient distance from the vertical leg 23 of the camber rail 21R for enabling placement therebetween of one chord member CH1 of a truss to be fabricated, and in which jaw 51 carried by the support plate 43 is spaced a sufficient distance from the vertical leg of the clamping bar 47 for enabling placement therebetween of the other chord member CH2, and a closed position (FIG. 6) in which the chord members are securely clamped between the jaws and their respective opposing clamping surfaces (i.e., the inner face of the vertical leg of the camber rail and the inner face of the vertical leg of the clamping bar). When the chord members CH1, CH2 are clamped in this position, the nailing plate portions NP of the metal web members W therebelow will be substantially centered with respect to the lower faces of the chord members, despite variations, within specified limits, in the thickness of the chord members. In this regard, the outer and intermediate clamping members 41, 43 and jaws 49, 51 thereon should be so dimensioned and disposed and the metal web member W so positioned (via locater pins 71) relative to the clamping members that the three nailing plate portions NP of the web member are exactly centered on the lower faces of chord members having a thickness of 1½ in. (the standard thickness of a 2×4). If the thickness of a chord member varies from this standard by a certain amount (e.g., 1/16 in.), the construction of clamping section 39 is such that the nailing plate portion (or portions) of the web member will be off-center with respect to the lower face of the chord member by only one-half that distance. Thus, the thickness of a chord member may range from 1 7/16 in.–1 9/16 in. and the nailing plate portion(s) will never be off-center more than 1/32 in. with respect to the lower face of the chord member.

It will be observed, therefore, that the apparatus of this invention automatically substantially centers the nailing plate portions of the metal web on the lower faces of the wood chord members despite variations, within certain limits, in the thickness of the chord members. Moreover, the outer and intermediate clamping members 41, 43 cooperate to maintain the outside dimension (i.e., depth) of the truss being formed within relatively close tolerances (e.g., 1/16 in.) which may be less than the cumulative tolerances (e.g., ⅛ in.) of the wood chord members CH1, CH2.

Figure 6:
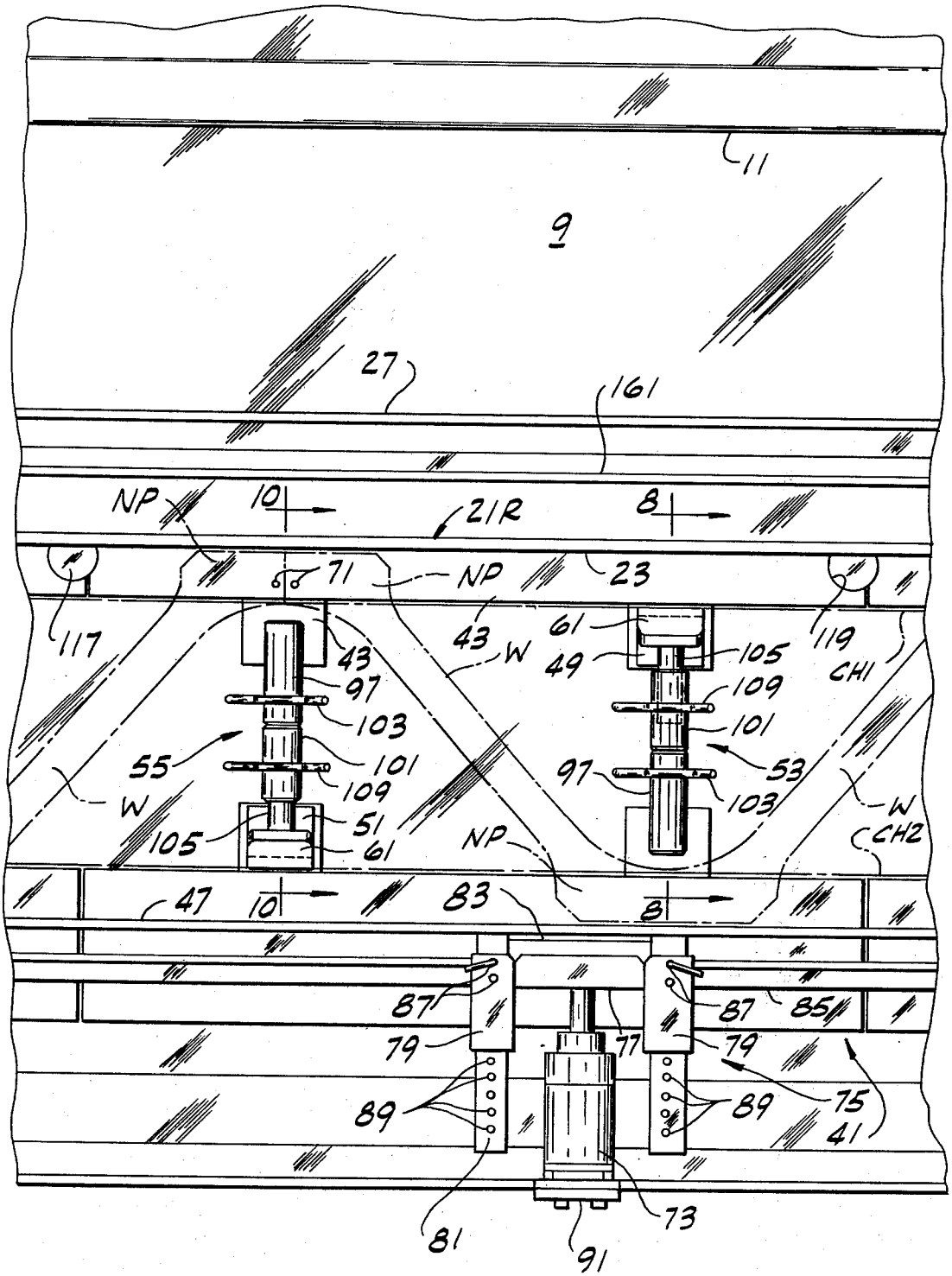
FIG. 6 is a view similar to FIG. 5 showing the clamping section in closed position.

Pneumatic cylinder unit 73 has a clamping assembly, generally designated 75, at the outer end of its piston rod engageable with the outer clamping member 41 for moving the latter between its FIG. 5 and FIG. 6 positions. This assembly 75 comprises a U-shaped clamp support 77 suitably secured to the piston rod of the air cylinder. Support 77 has a pair of parallel tubular arms 79 which telescopically receive the legs of a clamping head 81. A crossbar 83 extending between the two legs of the clamping head is received in a channel between the vertical leg of clamping bar 47 and the vertical leg of an angle bar 85 secured, as by welding, to the horizontal leg of the clamping bar. Thus, extension of the piston rod of cylinder unit 73 moves the outer and intermediate clamping members 41, 43 to the left on the bed toward their closed position and retraction of the rod moves the clamping members to the right on the bed toward their open position. The pins for pinning clamping head 83 in support 77 are indicated at 87. They extend down through holes in the arms of the support and in the legs of head 83. The legs of clamping head 83 have additional holes 89 therein spaced at equal intervals along their lengths for enabling the legs to be axially adjusted with respect to the clamp support for accommodating trusses of different depths. The cylinder unit is removably mounted on the table by means of a bracket 91 which has as sliding fit with the vertical flange of an angle iron 93 extending the length of the bed at the right side of the table.

The support means 53 and 55 for jaws 49, 51 are also adjustable to accommodate trusses of different depths. In this regard, support means 53 for jaw 49 on the outer clamping member 41 comprises a post or upright 95 (see FIG. 8) extending up from the base plate 45 and a cylindrical guide 97 extending horizontally from the upright toward the camber rail 21R, the spacing between upright 95 and the clamping bar being sufficient for accommodating wood chord member CH2 therebetween. Cylindrical guide 97 has several (e.g., three) sets of holes 99 therein spaced at intervals along its length. A tubular adapter 101 is received in the open left end of the guide and is secured in place by a cotter pin 103 extending through holes in the guide and in the adapter. A pin 105 extending horizontally from jaw 49 and having several (e.g., three) sets of radial bores 107 therein is received in the open left end of the adapter and is secured in place by a second cotter pin 109. To adjust jaw 49 toward and away from clamping bar 47 the cotter pins 103, 109 are pulled from their respective openings, the adapter 101 removed, and the jaw pin 105 inserted into the cylindrical guide 97 and secured in the desired axially adjusted position by inserting a cotter pin through aligned openings in the guide and jaw pin. Support means 55 for jaw 51 is identical in construction. By adjusting the two jaw support means 53, 55, the distance between clamping bar 47 and camber rail 21R may be varied for accommodating trusses of different depths.

Figure 11:
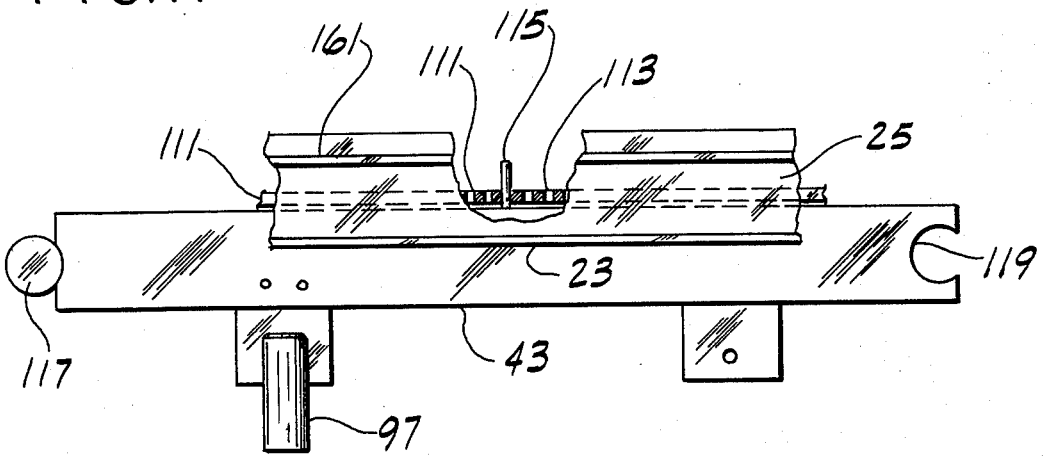
FIG. 11 is a plan of a support plate and camber rail of the positioning and holding apparatus, parts of the camber rail being broken away to illustrate details.

Extending the length of the camber rail 21R on the underside of its horizontal flange 25 is a locater bar 111 having a series of holes 113 therethrough (see FIG. 11) spaced at equal intervals (e.g., ½ in.) along the entire length of the bar. A pin 115 extending from the outer edge of the support bar 43 is received in one of these holes for securing the support bar (and thus the entire clamping section 39) in position longitudinally with respect to the bed. The position of the clamping section along the bed may be adjusted by inserting pin 115 into a different hole 113 in the locater bar.

The locater bar 111 also serves as a stop (or stop means) engageable by the support plate 43 to set the minimum spacing between jaw 49 and the vertical leg 23 of camber rail 21R, the minimum spacing being equal to the minimum acceptable thickness (e.g., 1⅝ in.) of chord member CH1. If the chord member is thinner than this minimum, the support plate 43, when moving to its FIG. 7 position, will engage the locater bar and prevent any further leftward movement of the plate. This in turn limits the extent to which the outer clamping member 41 and jaw 49 thereon can move toward the camber rail.

Inasmuch as the thickness of the wood chord members CH1, CH2 will vary to some degree along the length of the members, adjacent standard clamping sections 39 are connected for pivotal movement with respect to one another. More specifically, the support plate 43 of each standard clamping section has a flat circular pivot piece 117 at one end and a part-circular notch 119 on its other end, the ends of plate 43 thus being formed for pivotally mating with the ends of adjacent clamping sections. The outer clamping member 41 of each standard clamping section 39 is free of any connections with the outer clamping members of adjacent sections.

A short clamping section 41 is identical to a standard clamping section 39 except that it is only one-half as long and includes only one jaw corresponding to jaw 51 of a standard section. The short section jaw, and the jaw support means therefor, are identical in construction to those on a standard section. The support plate of the short section also has a circular pivot piece at one end (its left end as viewed in FIG. 1) which is receivable in the part-circular notch in one end of a standard section for pivotally connecting the two sections.

For purposes of this description, the short and standard clamping sections 41, 39 are shown arranged in FIGS. 1 and 1A on the right side of the bed 9 in two identical groupings 1-A, 2-A for fabricating two identical trusses of intermediate length (e.g., 18 ft.), although it will be understood that the sections could be rearranged to form one truss or more than two trusses. Each grouping 1-A, 2-A comprises two identical sets of short and standard clamping sections, the left set (as viewed in FIG. 1) being designated 125L and the right set 125R. Each set comprises a plurality (e.g., four) of pivotally connected standard sections 39, and a short (or end) clamping section 41. The spacing between the sets 125L, 125R is determined by the length of the truss being fabricated. Since stresses are typically the greatest at the ends of a truss, the position of the right set 125R of clamping sections on the table should be adjusted longitudinally with respect to the left set of sections 125L to ensure that the metal web members W at the ends of the truss are immediately adjacent the ends of the chord members CH1, CH2. Thus, for trusses of most lengths, the two sets of clamping sections 125L, 125R will be spaced apart, and in such instances, each set should have a short (rather than a standard) section 41 at its right end for properly supporting chord member CH2 against the clamping forces being applied by the pneumatic cylinder units 73. Where the length of the truss to be fabricated permits, the short section 41 of the left set 125L of sections may be eliminated and adjacent standard sections 39 of the two sets directly joined. The left ends of the wood chord members CH1, CH2 abut up against angles 127 secured (e.g., bolted) to the support plate 43 and base plate 45 of the leftmost standard clamping section 39 of the left set 125L of sections. These angles are adjustable lengthwise with respect to plates 43 and 45 for adjusting the relative position of the web members W with respect to the left end of a finished truss.

Figure 4:
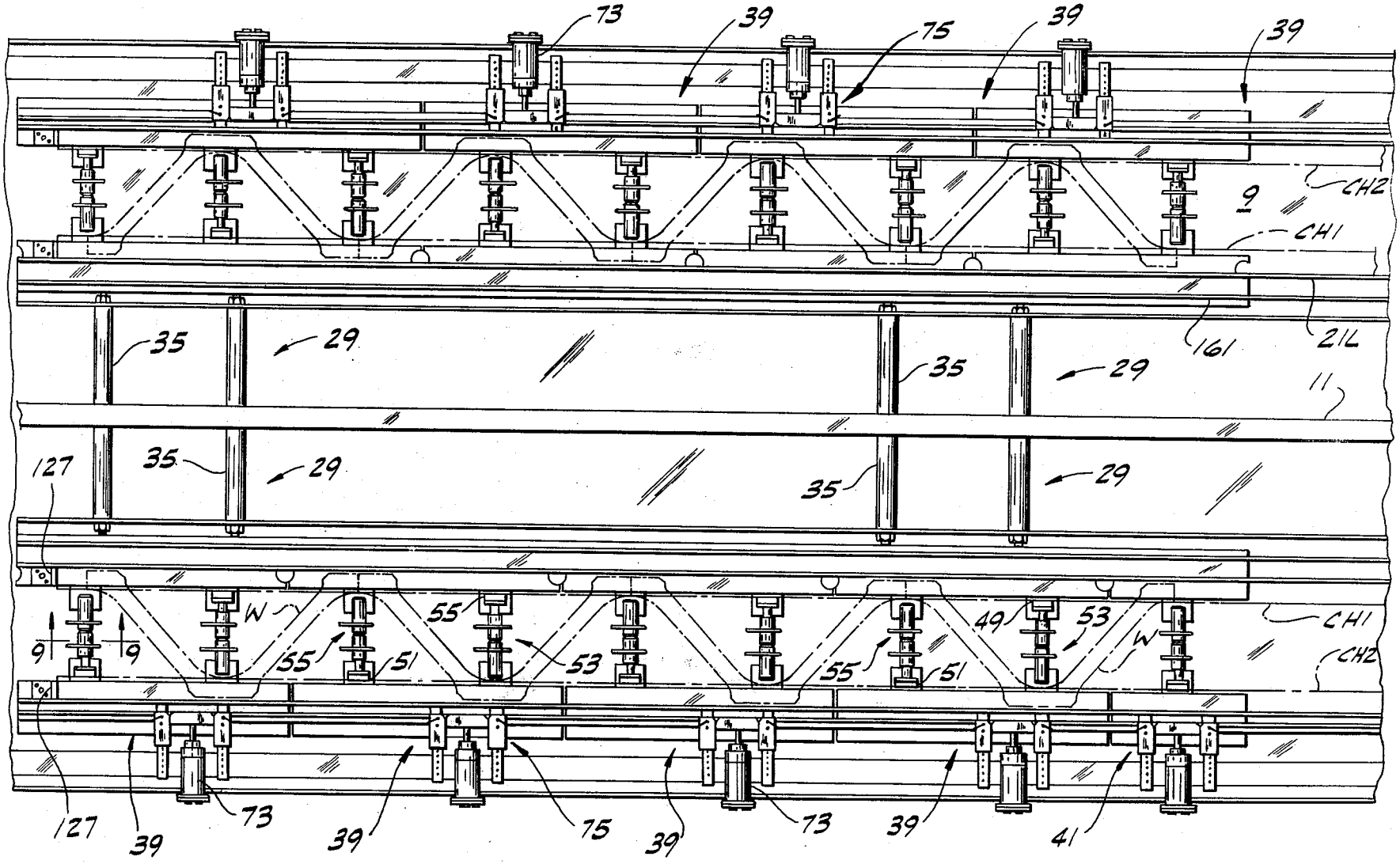
FIG. 4 is an enlarged plan of a portion of FIG. 1 shwing various clamping sections of the positioning and holding apparatus.

Apparatus 13L is operable for positioning and holding metal web and chord members on the left side of the bed to form a truss (or trusses) which is a mirror image of the truss (or trusses) formed on the right side of the table. Apparatus 13L is similar to apparatus 13R in that it comprises a camber rail 21L rigidly affixed to the bed and extending longitudinally with respect thereto from one end of the table to the other. This camber rail is identical in shape and configuration to camber rail 21R on the right side of the table except that it is cambered in the opposite direction. Moreover, it is secured to the bed in the same manner as camber rail 21R and by the same threaded rods 31 which extend through the box beam 11 at the center of the table. Apparatus 13L includes a plurality of interconnected clamping sections of three different types, namely, standard and short clamping sections which are identical in construction and operation to those described above and thus identified by the same reference numerals (i.e., 39 and 41, respectively), and long clamping sections, generally designated 129. A long clamping section comprises a standard section 39 and a short section 41 rigidly joined together (as by welding) end-to-end, as shown in FIG. 4.

The clamping sections 39, 41 and 129 of apparatus 13L are arranged on the left side of the bed in two identical groupings 1-B, 2-B for fabricating two identical trusses symmetrical about the longitudinal centerline of the table to those on the right side of bed 9. As viewed from left to right in FIG. 1, grouping 1-B comprises two identical sets of clamping sections, the left set being designated 131L, and the right set 131R. The left set comprises a long clamping section 129 and three standard sections 39, all pivotally connected end-to-end. The right set 131R comprises a short section 41 and three standard sections 39 which, again, are all pivotally connected end-to-end. The left ends of the chord members of a truss being fabricated abut up against angles 133 identical to angles 127 of apparatus 13R.

Press 15 comprises a generally U-shaped press frame 135 extending below the table and up at opposite sides of the table, and a press head 137 disposed above the bed (but below framework 17) between the sides of the frame. The press is generally of the same construction as that shown in U.S. Pat. No. 4,024,809, except for the upper platen arrangement. Press 15 differs in this latter regard in that a pair of carriages 139, one of each side of the table, are mounted on the press head 137 for movement in side-to-side direction with respect to the table above respective sides of the bed. Each carriage 139 carries platen means comprising a pair of elongate generally parallel pressing shoes 141 on the underside of the pressing head extending longitudinally with respect to the table, the shoes being spaced apart a distance corresponding to the spacing between the wood chord members CH1, CH2 when clamped in their final (FIG. 7) position at a respective side of the table. As described in detail in the above-mentioned U.S. Pat. No. 4,024,809, the press frame 135 and press head 137 are movable up and down relative to the bed 9 for moving the carriages and two sets of pressing shoes 141 thereon between a raised position in which the shoes are spaced above the wood chord members and the metal web members resting atop the chord members at each side of the table, and a lowered position in which the shoes drive the nailing plate portions NP of the upper and lower metal web members into the narrow (1½ in.) faces of the chord members. The two shoes on each carriage 139 are preferably longer than the width D of a metal web member so that during each pressing cycle they fully embed one upper web member and one lower web member into the wood chord members at a respective side of the table.

Figure 7:
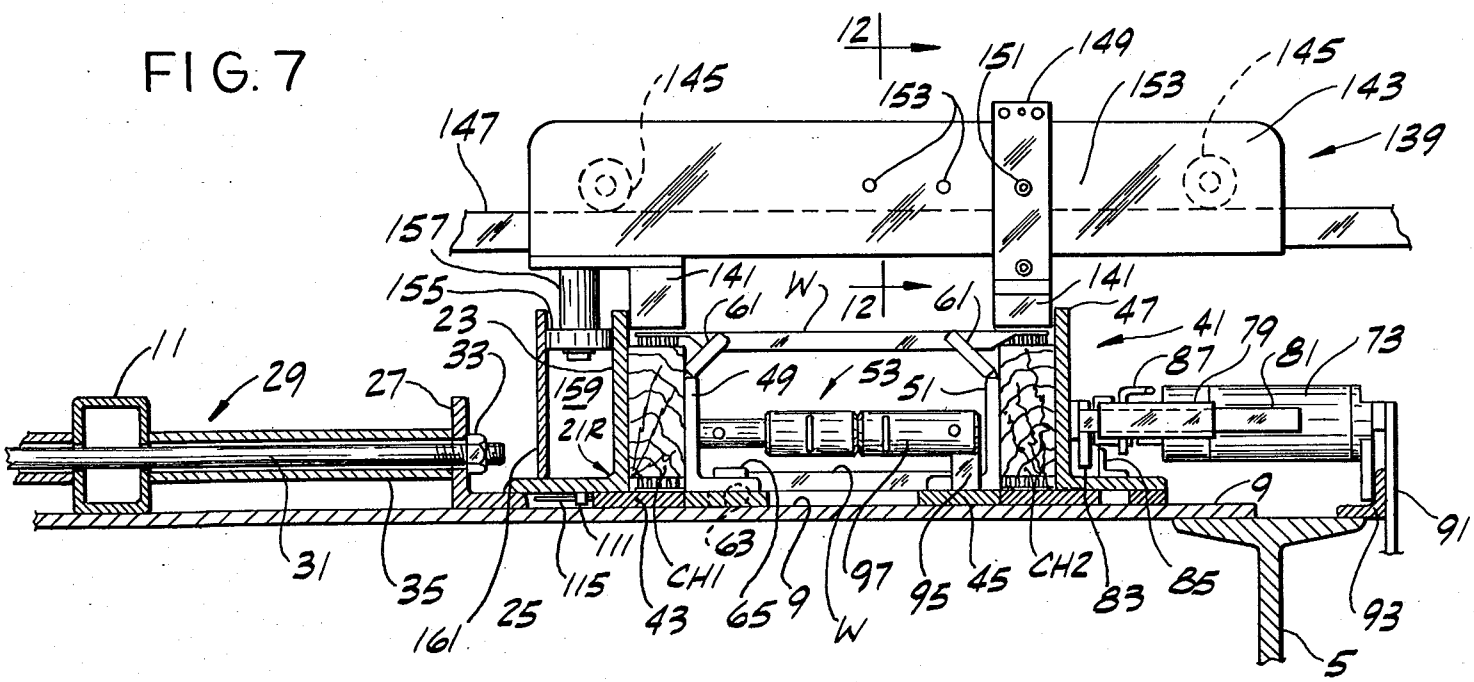
FIG. 7 is an enlarged left end elevation of a portion of FIG. 1.
Figure 12:
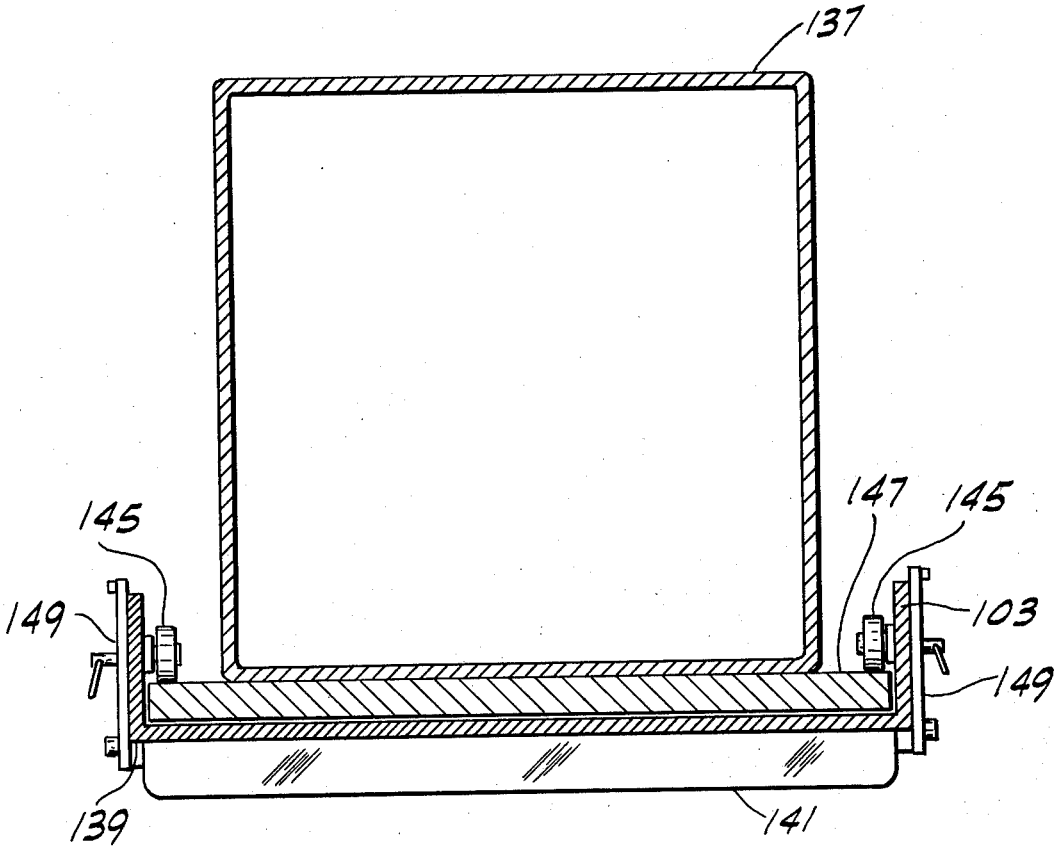
FIG. 12 is a vertical section on line 12—12 of FIG. 7.

As shown in FIGS. 7 and 12, each carriage 139 is mounted on the underside of press head 137 and is generally of channel shape, having vertical flanges 143 extending upwardly at the sides of the press head. A pair of rollers 145 are pinned to each of these flanges adjacent opposite ends of the carriage and support the carriage for rolling movement on a tracking plate 147 affixed to the bottom of the press head. The pressing shoes are mounted on the underside of carriage 139, one shoe (the left shoe as viewed in FIG. 7) being rigidly secured on the underside of the carriage and the other (right) shoe being adjustable with respect to the carriage for varying the spacing between the shoes to accommodate trusses of different depths. More specifically, this latter shoe is carried by a pair of brackets 149 fastened to the vertical flanges 143 of the carriage by means of a pin 151 extending through holes in the brackets and the carriage flanges. Other holes 153 spaced along the flanges enable the shoe to be adjusted toward and away from the fixed shoe.

As the press moves along the table, the carriages are adapted to move transversely with respect to the bed an amount corresponding to the camber in camber rails 21R, 21L for maintaining the pressing shoes 141 directly above the upper faces of the wood chord members and the nailing plate portions NP of the metal web members when the outer and intermediate clamping members 41, 43 of the clamping sections are in their closed position. To accomplish this, each carriage has a follower means thereon constituted by a roller 155 mounted for rotation about a generally vertical axis at the lower end of a pin 157 extending down from the bottom of the carriage. Roller 155 is received in a guideway 159 which extends the length of the table generally parallel to the vertical flange 23 of a respective camber rail 21R, 21L between the camber rail and the box beam 11 at the center of the table. Guideway 159 is in the form of an upwardly opening channel defined at one side by one face of the vertical flange of the camber rail and at its other side by the opposing face of a vertical guide rail 161 which is cambered to generally parallel the camber rail.

Operation of truss-fabricating machine 1 is as follows:

Assuming that four trusses of intermediate length (e.g., 18 ft.) are to be fabricated, two at each side of the table, apparatus 13L, 13R are positioned on the bed as shown in FIGS. 1 and 1A, with the center and intermediate clamping members 41, 43 of the various clamping sections in their open (FIG. 5) position. Jaw support means 53, 55 on the outer and intermediate clamping members of the various clamping sections are suitably adjusted according to the depth of the truss to be fabricated. The clamping assemblies 75 of the pneumatic cylinder units 73 and the spacing between the pressing shoes 141 on each carriage 139 are also adjusted. Metal web members W are then placed with their teeth T facing upwardly on support plates 43 of the intermediate clamping members and the base plates 45 of the outer clamping members between the camber rails 21R, 21L and the clamping bars 47 of the outer clamping members 41. The web members are properly positioned with respect to the clamping members by means of locater pins 71. Wood chord members are then placed between the jaws 49, 51 and their respective opposing clamping surfaces (camber rails 21R, 21L and clamping bars 47) with the left ends of the chord members butting up against angles 127 at the right side of the bed and against angles 133 at the left side of the bed.

Pneumatic cylinder units 73 are then actuated to move the outer and intermediate clamping members 41, 43 of the various clamping sections from their open to their closed (FIG. 6) position in which the wood members are securely clamped relative to one another with the nailing plate portions NP of the lower metal web members substantially centered transversely with respect to the lower faces of the chord members. As the outer and intermediate clamping members of the various clamping sections move to their closed position they pivot relative to one another for accommodating variations in thickness of the chord members along their lengths. When the chord members are securely clamped (assuming that they are thicker than the above-mentioned predetermined minimum spacing between the jaws and their opposing clamping surfaces), the upper series of metal web members are manually placed atop the chord members directly above the lower chord members with the nailing plate portions substantially centered on the upper faces of the chord members.

When the upper web members W are in place, the press 15 is advanced to the right as viewed in FIG. 1 until the pressing shoes 141 of the carriages 139 are directly above the nailing plate portions NP of the first metal web members of the trusses being fabricated on opposite sides of the bed, which trusses are symmetrical about the longitudinal centerline of the table. The press is stopped in this position and the appropriate controls actuated to lower the press frame 135 and head 137 to move the pressing shoes 141 from their raised to their lowered position in which they drive the teeth of the first set of upper and lower metal web members W into the chord members. The press head is then raised and the press advanced forward (to the right) until the pressing shoes are disposed directly above the second set of upper and lower web members and another pressing cycle is initiated. This process is repeated until the press has advanced the length of the table and all four trusses are completed.

While the web and chord members of the two trusses at the right end of the table are being pressed together, the completed trusses at the left end of the table are removed from the table by actuating pneumatic cylinders 73 to move the outer and intermediate clamping members 41, 43 to their open (FIG. 5) position; and then lifting the completed trusses from the clamping sections. This may be accomplished quickly and easily due to the relatively large spacing between jaws 49 and 51 and their respective opposing clamping surfaces when the clamping members are in their open position. The lower web members and chord members of two more trusses to be formed at the left end of the table are then placed in the clamping sections, the air cylinders actuated to move the outer and intermediate clamping members 41, 43 to their closed position, and the upper metal webs positioned atop the chord members. Thus, when the two trusses at the right end of the table are completed the press may be returned to the left end of the table for immediate resumption of operation. While the press is assembling these trusses, the completed trusses at the right end of the table are removed and replaced by more wood and chord members for two more trusses to be fabricated.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for positioning and holding on an elongate bed pieces of a structure to be fabricated, such as the pieces of a floor truss of the type comprising a pair of generally parallel spaced-apart wood chord members and a series of relatively flat metal web members having connector portions with teeth struck therefrom adapted to be pressed into the wood chord members for rigidly interconnecting them, said apparatus comprising:

abutment means having a first generally vertical clamping surface adapted to extend longitudinally with respect to said bed for engagement by one face constituting the outer face of one of said chord members; and clamping means adapted to be mounted on the bed for (a) moving said web and chord members from an initial unassembled position in which the web members are disposed generally horizontally above the bed with said teeth facing upwardly and in which said wood chord members overlie said web members, to a final position in which said one chord member abuts said first clamping surface of said abutment means and said connector portions of the web members are substantially centered transversely with respect to the lower faces of the chord members, and (b) clamping said web and chord members in said final position;

said clamping means having at least one section comprising:

an outer clamping member having a second generally vertical clamping surface facing said first clamping surface and spaced therefrom for engagement with one face constituting the outer face of the other of said chord members;

an intermediate clamping member between said abutment means and said outer clamping member, said outer and intermediate clamping members being slidable transversely with respect to the bed toward and away from said abutment means and being interconnected to permit lost-motion movement therebetween in the transverse direction;

a first jaws on the outer clamping member facing said first vertical clamping surface of said abutment means for engaging the inner face of said one chord member;

a second jaw on the intermediate clamping member facing said second vertical surface of said outer clamping member for engaging the inner face of said other chord member;

means for mounting a metal web member on the intermediate clamping member in generally horizontal position with said teeth facing upwardly and with a connector portion of the web member generally adjacent said first clamping surface of said abutment means and a connector portion generally adjacent said second clamping surface of the outer clamping member; and means for moving said outer and intermediate clamping members transversely with respect to the bed toward and away from said abutment means between an open position in which said first jaw on the outer clamping member is spaced a sufficient distance from said first vertical surface of said abutment means for enabling placement therebetween of said one chord member and in which said second jaw on the intermediate clamping member is spaced a sufficient distance from said second vertical surface of said outer clamping member for enabling placement therebetween of said other wood chord member, and a closed position in which said web and chord members are in said final position with said chord members securely clamped between said vertical surfaces and said jaws and overlying the connector portions of said web member.

2. Apparatus as set forth in claim 1 wherein said clamping means comprises a plurality of said sections connected for pivotal movement with respect to one another.

3. Apparatus as set forth in claim 2 wherein the intermediate clamping member of each section is pivotally connected to the intermediate clamping members of adjacent sections.

4. Apparatus as set forth in claim 3 wherein the outer clamping member of each section is free of connection with the outer clamping member of adjacent sections.

5. Apparatus as set forth in claim 1 wherein said abutment means is adapted to be mounted in fixed position on the bed and said clamping means sections are adjustable longitudinally with respect to the abutment means, said apparatus further comprising means for securing said sections in longitudinally adjusted position.

6. Apparatus as set forth in claim 5 wherein said securing means comprises a series of holes spaced at intervals longitudinally of the abutment means, and a pin on said intermediate clamping member receivable in a selected hole thereby to secure the clamping member in said longitudinally adjusted position.

7. Apparatus as set forth in claim 1 further comprising means for adjusting the spacing between said first and second vertical clamping surfaces when the clamping members are in said closed position thereby to accommodate trusses of different depths.

8. Apparatus as set forth in claim 7 wherein said adjusting means comprises first and second jaw supports mounting said first and second jaws, respectively, on said clamping members, said first jaw support being adjustable for varying the spacing between said first jaw and said second vertical clamping surface, and said second jaw support being adjustable for varying the spacing between said second jaw and said first vertical clamping surface when said clamping members are in said closed position.

9. Apparatus as set forth in claim 1 wherein said outer and intermediate clamping members have a pair of lost-motion connections therebetween spaced apart longitudinally with respect to the members.

10. Apparatus as set forth in claim 9 wherein said pair of lost-motion connections between said outer and intermediate clamping members comprises a pin-and-slot connection between said first jaw and said intermediate clamping member and a pin-and-slot connection between said second jaw and said outer clamping member.

11. Apparatus as set forth in claim 10 wherein each jaw is generally L-shaped as viewed from the side, comprising generally vertical and horizontal legs, the slot of each pin-and-slot connection being in the horizontal leg of a respective jaw and the pin being on a respective clamping member.

12. Apparatus as set forth in claim 1 further comprising stop means engageable by said intermediate clamping member as the clamping members move to said closed position for limiting movement of said outer clamping member and said first jaw thereon toward said first vertical clamping surface.

13. Apparatus as set forth in claim 12 wherein said abutment means comprises a rail adapted to be mounted in fixed position on the bed with the bottom of the rail spaced above the bed, the rail having a face constituting said first vertical clamping surface, said intermediate clamping member comprising an elongate support plate slidable transversely with respect to the bed beneath the rail, said stop means being mounted on the underside of the rail and being engageable by the support plate for limiting sliding of the latter beneath the rail.

14. Apparatus as set forth in claim 1 wherein said means for mounting a metal web member on the intermediate clamping member comprises a pin extending upwardly from the intermediate clamping member receivable in an opening in the web member.

15. Apparatus as set forth in claim 1 wherein said outer clamping member has an upwardly facing surface extending generally horizontally inwardly from said second vertical clamping surface and said intermediate clamping member has an upwardly facing surface generally coplanar with the upwardly facing surface of the outer clamping member, said upwardly facing surfaces being adapted to support a metal web member thereon in generally horizontal position between said first and second clamping surfaces.

16. Apparatus as set forth in claim 15 wherein said abutment means comprises a rail adapted to be mounted in fixed position with respect to said bed, said rail having a vertical face constituting said first vertical clamping surface, said intermediate clamping member comprising an elongate support plate adapted to extend longitudinally of the bed between said rail and said outer clamping member, said support plate being slidable on the bed transversely with respect thereto, said first jaw being mounted on said outer clamping member and having a lost-motion connection with said support plate and said second jaw being mounted on the support plate and having a lost-motion connection with the outer clamping member.

17. Apparatus as set forth in claim 16 wherein said lost-motion connections are pin-and-slot connections.

18. Apparatus as set forth in claim 17 wherein each jaw is generally L-shaped as viewed from the side, comprising generally vertical and horizontal legs, the slot of said pin-and-slot connection being in the horizontal leg of the jaw and the pin being on the respective clamping member.

19. Apparatus as set forth in claim 1 wherein said means for moving said outer and intermediate clamping members between said open and closed positions comprises a pneumatic cylinder unit.

20. Apparatus as set forth in claim 19 wherein said cylinder unit is engageable with said outer clamping member for moving said outer and intermediate clamping members between said open and closed positions.

21. A machine for fabricating floor trusses or the like comprising a pair of generally parallel spaced-apart wood chord members and a series of relatively flat metal web members having connector portions with teeth struck therefrom adapted to be pressed into the wood chord members for rigidly interconnecting them, said machine comprising:

an elongate bed for supporting said web and chord members in an initial unassembled position in which the web members are generally horizontal with said teeth facing upwardly and in which the wood chord members overlie the web members;

abutment means having a first generally vertical clamping surface extending longitudinally with respect to the bed for engagement by one face constituting the outer face of one of said chord members;

clamping means adapted to be mounted on the bed for (a) moving said web and chord members from said initial unassembled position to a final position in which said one chord member abuts said first clamping surface of said abutment means and said connector portions of the web members are substantially centered transversely with respect to the lower faces of the chord members, and (b) clamping said web and chord members in said final position; and a press movable longitudinally with respect to the bed for driving said teeth into the wood chord members when said web and chord members are clamped in their final position;

said clamping means having a plurality of sections each comprising:

an outer clamping member having a second generally vertical clamping surface facing said first clamping surface and spaced therefrom for engagement with one face constituting the outer face of the other of said chord members;

an intermediate clamping member between said abutment means and said outer clamping member, said outer and intermediate clamping members being slidable transversely with respect to the bed toward and away from said abutment means and being interconnected to permit lost-motion movement therebetween in the transverse direction;

a first jaw on the outer clamping member facing said first vertical clamping surface of said abutment means for engaging the inner face of said one chord member;

a second jaw on the intermediate clamping means facing second vertical surface of said outer clamping member for engaging the inner face of said other chord member;

means for mounting a metal web member on the intermediate clamping member in generally horizontal position with said teeth facing upwardly and with a connector portion of the web member generally adjacent said first clamping surface of said abutment means and a connector portion generally adjacent said second clamping surface of the outer clamping member; and means for moving said outer and intermediate clamping members transversely with respect to the bed toward and away from said abutment means between an open position in which said first jaw on the outer clamping member is spaced a sufficient distance from said first vertical surface of said abutment means for enabling placement therebetween of said one chord member and in which said second jaw on the intermediate clamping member is spaced a sufficient distance from said second vertical surface of said outer clamping member for enabling placement therebetween of said other wood chord member, and a closed position in which said web and chord members are in said final position with said chord members securely clamped between said vertical surfaces and said jaws and overlying the connector portions of said web member.

22. A truss-fabricating machine as set forth in claim 21 wherein said abutment means comprises a camber rail rigidly affixed to the bed and extending longitudinally with respect thereto, said rail having a predetermined camber therein as mounted on the bed.

23. A truss-fabricating machine as set forth in claim 22 wherein said press comprises a press head disposed above the bed, a carriage mounted on the head for movement in side-to-side direction with respect to the bed above said camber rail and said clamping means, and platen means carried by the carriage movable from a raised position to a lowered position for driving the teeth of the metal web member into the chord members, said apparatus further comprising means for moving said carriage, as the press moves along the bed, transversely with respect to the bed in correspondence with the camber in the camber rail thereby to maintain said platen means directly above the upper faces of said wood chord members when in said final position.

24. A truss-fabricating machine as set forth in claim 23 wherein said means for moving said carriage comprises means forming a guideway generally parallel to said camber rail, and follower means on the carriage receivable in the guideway.

25. A truss-fabricating machine as set forth in claim 24 wherein said guideway is in the form of an upwardly opening channel.

26. A truss-fabricating machine as set forth in claim 25 wherein said follower means comprises a roller mounted on said carriage for rotation about a generally vertical axis, said roller being receivable in said guideway.

27. A truss-fabricating machine as set forth in claim 24 wherein said guideway is on the side of the camber rail opposite said one chord member.

28. A truss-fabricating machine as set forth in claim 24 further comprising a guide rail extending longitudinally of the bed generally parallel to said camber rail on the side of the camber rail opposite said one chord member, said rails having opposing general vertical faces forming said guideway therebetween.

29. A truss-fabricating machine as set forth in claim 23 wherein said platen means comprises a pair of elongate generally parallel pressing shoes extending longitudinally with respect to the bed, said shoes being spaced apart a distance corresponding to the spacing between said wood chord members when clamped in said final position.

30. A truss-fabricating machine as set forth in claim 29 wherein the spacing between said shoes is adjustable for accommodating trusses of different size.

31. A machine for fabricating floor trusses or the like comprising a pair of generally parallel spaced-apart wood chord members and a series of relatively flat metal web members having connector portions with teeth struck therefrom adapted to be pressed in the wood chord members for rigidly interconnecting them, said machine comprising:

an elongate bed for supporting said web and chord members in an initial unassembled position in which the web members are generally horizontal with said teeth facing upwardly and in which the wood chord members overlie the web members;

a camber rail rigidly affixed to the bed and extending longitudinally with respect thereto with a predetermined camber therein, said rail having a generally vertical clamping surface engageable by one face constituting the outer face of one of said chord members;

means on the bed for clamping said web and chord members in a final position in which said chord members overlie said connector portions of said web members with said one chord member abutting the clamping surface of the camber rail;

a press movable longitudinally with respect to the bed comprising a press head disposed above the bed, a carriage mounted on the press head for movement in side-to-side direction with respect to the bed above said camber rail and said clamping means, and platen means carried by the carriage movable from a raised position to a lowered position for driving the teeth of the metal web member into the chord members; and means for moving said carriage, as the press moves along the bed, transversely with respect to the bed in correspondence with the camber in the camber rail thereby to maintain said platen means directly above the upper faces of said wood chord members when in said final position.

32. A truss-fabricating machine as set forth in claim 31 wherein said means for moving said carriage comprises means forming a guideway generally parallel to said camber rail, and follower means on the carriage receivable in the guideway.

33. A truss-fabricating machine as set forth in claim 32 wherein said guideway is in the form of an upwardly opening channel.

34. A truss-fabricating machine as set forth in claim 33 wherein said follower means comprises a roller mounted on said carriage for rotation about a generally vertical axis, said roller being receivable in said guideway.

35. A truss-fabricating machine as set forth in claim 32 wherein said guideway is on the side of the camber rail opposite said one chord member.

36. A truss-fabricating machine as set forth in claim 32 further comprising a guide rail extending longitudinally of the bed generally parallel to said camber rail on the side of the camber rail opposite said one chord member, said rails having opposite general vertical faces forming said guideway therebetween.

37. A truss-fabricating machine as set forth in claim 31 wherein said platen means comprises a pair of elongate generally parallel pressing shoes extending longitudinally with respect to the bed, said shoes being spaced apart a distance corresponding to the spacing between said wood chord members when clamped in said final position.

38. A truss-fabricating machine as set forth in claim 37 wherein the spacing between said shoes is adjustable for accommodating trusses of different size.

* * * * *